US005282642A

United States Patent [19]

Provence

[11] Patent Number: 5,282,642

[45] Date of Patent: Feb. 1, 1994

[54] APPARATUS FOR BIASING

[75] Inventor: Marc Provence, Thorens-les-Glieres, France

[73] Assignee: Salomon S.A., Annecy Cedex, France

[21] Appl. No.: 662,959

[22] Filed: Mar. 1, 1991

[30] Foreign Application Priority Data

Mar. 2, 1990 [FR] France ..... 90 02824

[51] Int. Cl.[5] ..... A63C 9/00

[52] U.S. Cl. ..... 280/615

[58] Field of Search ..... 280/614, 615, 607, 634, 280/617, 618, 611, 601

[56] References Cited

U.S. PATENT DOCUMENTS 4,468,048 8/1984 Wittmann et al. ..... 280/614

FOREIGN PATENT DOCUMENTS 0096094 12/1983 European Pat. Off. .
3539315 9/1986 Fed. Rep. of Germany .
669114 11/1929 France ..... 280/615
2595952 9/1987 France .

*Primary Examiner*—Richard M. Camby
*Attorney, Agent, or Firm*—Sandler, Greenblum & Bernstein

[57] ABSTRACT

An apparatus for biasing a shoe or boot on a ski, the shoe comprising an external sole maintained on the ski at its front end by a latching apparatus in a manner so as to allow for the lifting of the shoe from the ski. The return apparatus is constituted by at least one beam connected to the ski and adapted to be biased in flexion and/or torsion at its front free end by the shoe in a biased zone.

49 Claims, 4 Drawing Sheets

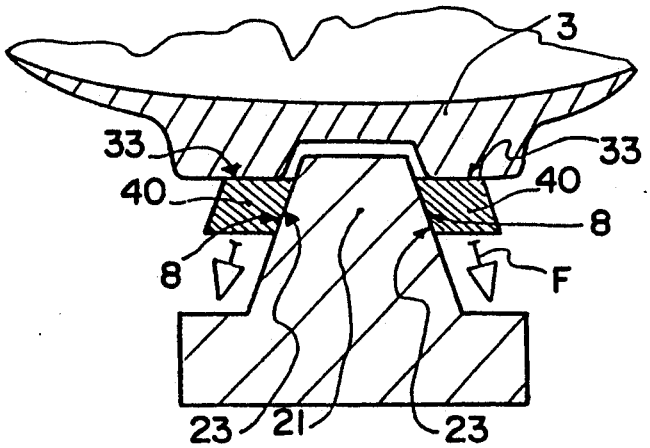
FIG. 4
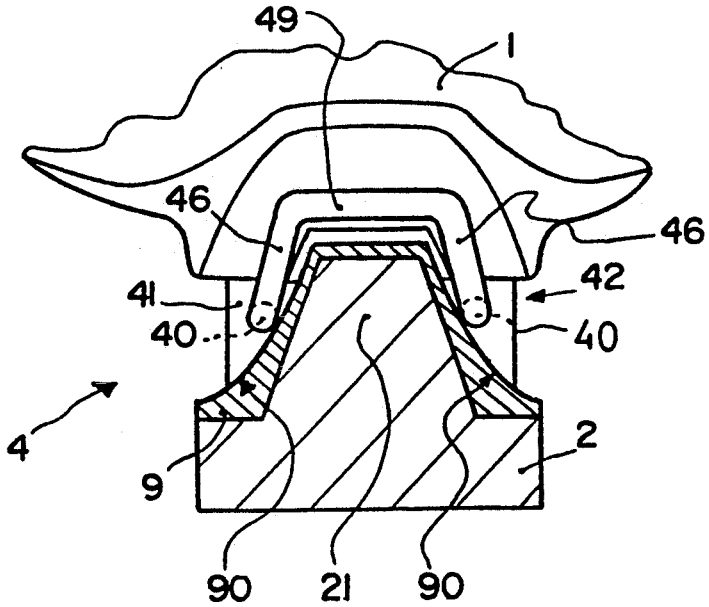
FIG. 5
FIG. 6
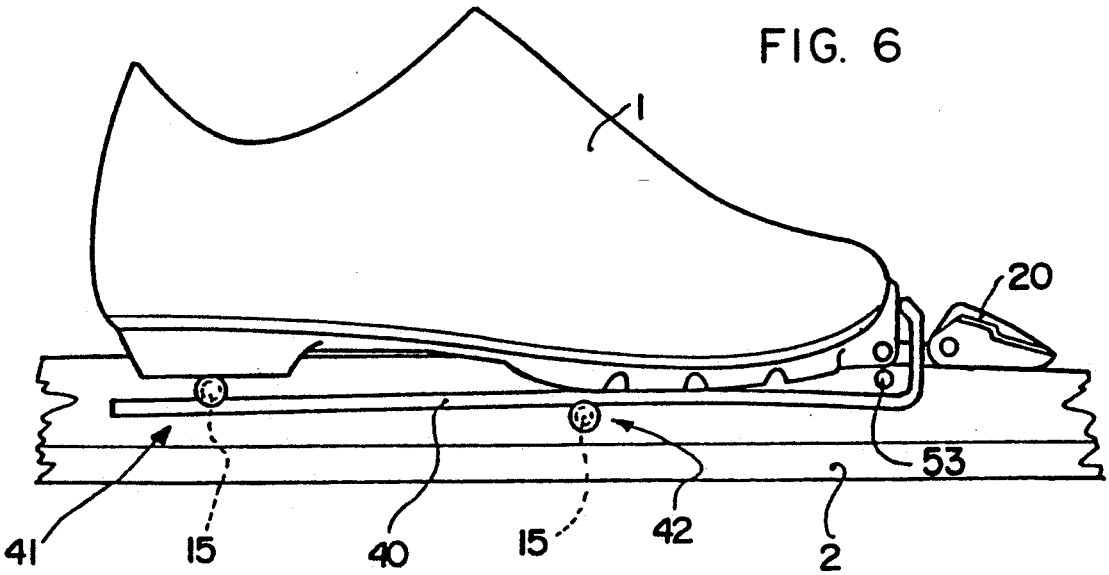

APPARATUS FOR BIASING

BACKGROUND OF THE INVENTION

1. Field of the Invention

The present invention is related to an apparatus for biasing a shoe on a ski after lifting of the shoe from the upper surface of the ski.

2. Background of the Invention

Known biasing apparatus are generally constituted by a spring which is supported, on the one hand, on a portion of a latching apparatus of the sole of the shoe on the ski, and on the other hand, on the front end on the sole of the shoe.

There are likewise such known biasing apparatus whose spring is constituted by a bumper made out of elastic material maintained in the latching apparatus.

These traditional biasing apparatus have the disadvantage of causing a relatively small return force, the dimensions of the spring or of the bumper being limited by the dimensions of the latching apparatus. If one wishes to exert a more substantial return force, the volume of the spring or of the bumper must be increased, which necessarily increases the size of the latching apparatus, and detracts from the aesthetics of the ski/shoe/latching apparatus assembly.

The spring of traditional apparatus is situated in front of the foot, which creates a field of pressure of the ski on the snow which is substantially centered in front of the axis of rotation of the foot during lifting of the shoe from the upper surface of the ski.

The contact of the ski with the snow is thus not optimum in the case of cross country ski for which the pressure field must approximately be centered under the foot to provide maximum contact between the coating chamber and the snow.

Furthermore, the spring return apparatus or elastic bumper do not make it possible to vary the return force of the shoe on the ski other than by replacing the spring or bumper, this replacement requiring disassembly of the return apparatus.

SUMMARY OF THE INVENTION

It is an object of the present invention, therefore, to overcome these disadvantages and to furnish a biasing apparatus for biasing the shoe on the ski whose return force is of a relatively elevated intensity, this intensity being adjustable without disassembling the return apparatus or replacing it.

Another object of the present invention is to propose a biasing apparatus which causes an improved contact between the ski and the snow during lifting of the shoe from the upper surface of the ski.

These objects are achieved in the biasing apparatus according to the invention, by virtue of the fact that it is constituted by at least one beam defined by a front and a rear end, each beam being linked with the ski at its rear end through a rear linkage apparatus. The front end is free and adapted to be biased by the shoe in a biased zone, during lifting of the shoe, the beam likewise being linked with the ski between its rear end and its front end by at least one intermediate support apparatus.

On the other hand, according to one preferred embodiment, at least one of the support or linkage apparatus of each beam is adjustable in position along the length of the longitudinal axis of the ski, which makes it possible to adjust the intensity of the bias of the boot on the ski without disassembling the biasing apparatus. The beams have the advantage, by virtue of their length, and likewise by virtue of their elevated modulus of elasticity, and their substantial volume, of providing high energy, and thus a biasing force of a relatively elevated intensity, this, in response to a low displacement of the biased point, i.e., for reduced work of the beams causing reduced aging thereof.

According to a preferred embodiment, the beams are positioned under the sole of the shoe in a manner so as to reduce the volume and the number of elements positioned on the top of the ski, in front of the front end of the shoe or on both sides thereof.

The bias of the beam can be made up of a flexional force, a torsional moment, or by the combination of these two components.

BRIEF DESCRIPTION OF THE DRAWINGS

The invention will be better understood with reference to additional characteristics thereof illustrated in the description which follows, with the aid of the annexed schematic drawings given by way of non-limiting examples only of a number of embodiments, in which:

FIG. 4 is a transverse cross-sectional view of a third embodiment of the invention;

FIG. 5 is a transverse cross-sectional view of a fourth embodiment of the invention;

FIG. 6 is a side view of a fifth embodiment according to the invention;

DESCRIPTION OF PREFERRED EMBODIMENTS

Figure 1:
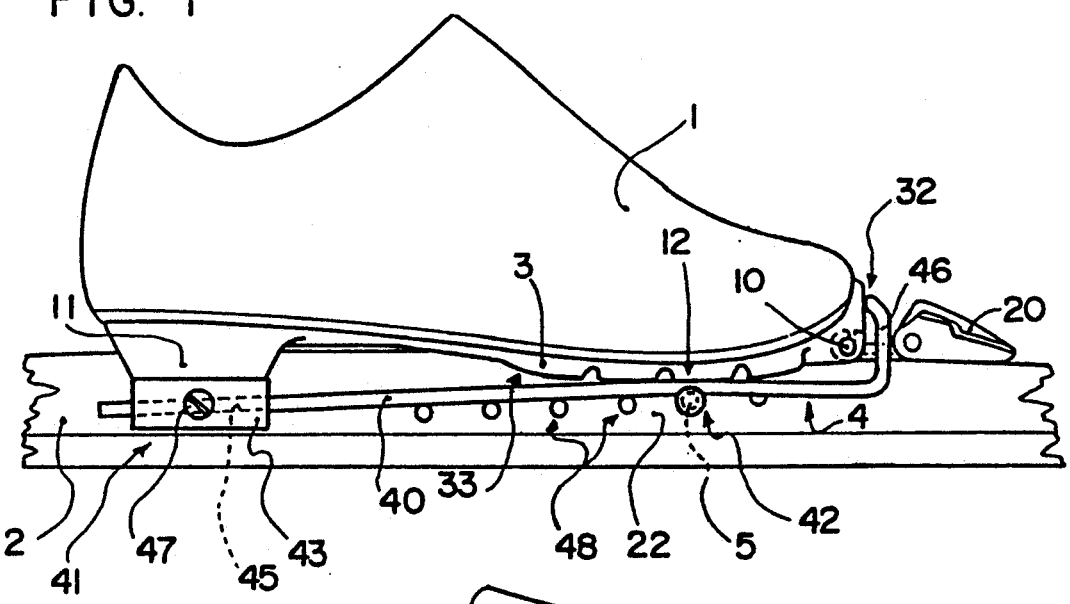
FIG. 1 is a side view of a first embodiment of the biasing apparatus according to the invention.

FIG. 1 illustrates a biasing apparatus, according to the invention, for biasing a ski shoe 1 on a ski 2. Shoe 1 is maintained on ski 2 at its front end by latching apparatus 20.

The latching apparatus 20 is constituted by a binding 20 of the known type allowing for journalling of the shoe 1 with respect to ski 2 around a rotational axis 10 affixed to the sole 3 of shoe 1. This latching apparatus 20 can be of any type allowing for the lifting of the shoe 1 of the skier, and thus requiring a return thereof on ski 2. The latching apparatus 20 can likewise be constituted by any apparatus linking the sole 3 to the ski 2, where desired up until the zone of the metatarsus 12, i.e., of the stirrup, for example.

In FIG. 1, the return apparatus 4 is constituted by a beam 40 linked with ski 2 at its rear end, through a rear linkage apparatus 41, and, between its rear end and its front end, by an intermediate support apparatus 42. The rear linkage apparatus 41 of beam 40 forms an embedded linkage of beam 40 with respect to ski 2. This embedded linkage is constituted according to one preferred embodiment, by an applied element 43, affixed to ski 2 by screwing, gluing or any other linkage means. This applied element 43 comprises a longitudinal hole 45 in which one introduces the beam 40 through its rear end. The translational movement of beam 40 in the longitudinal hole 45 is prevented by a screw 47 screwed into the threaded hole which is substantially transverse and is provided in the applied element 43. The end of the screw 47 presses the beam 40 in its longitudinal hole 45 and thus prevents the translation movement of beam 40.

According to the various embodiments shown, sole 3 of boot 1 comprises a groove 31 (FIG. 3) which is substantially longitudinal and is defined by a lower surface 33 of the sole 3, and which cooperates with a corresponding rib 21 which is substantially longitudinal and is provided on the ski 2 and is defined by lateral inclined sides 22 extending symmetrically on both sides of the substantially horizontal upper surface 24 on both sides of the median plane of ski 2. The lateral inclined sides 22 are each contiguous with a lower substantially horizontal surface 25, and extends until the lateral exterior sides 26 of ski 2. The cooperation of rib 21 and groove 31 advantageously allows for the lateral guidance of the shoe 1 with respect to ski 2. Rib 21 can be an integral portion of ski 2 or can be applied thereto.

A return apparatus 4, according to the invention, can likewise be mounted on a ski 2 of rectangular cross-section not having lateral guidance rib 21.

Figure 3:
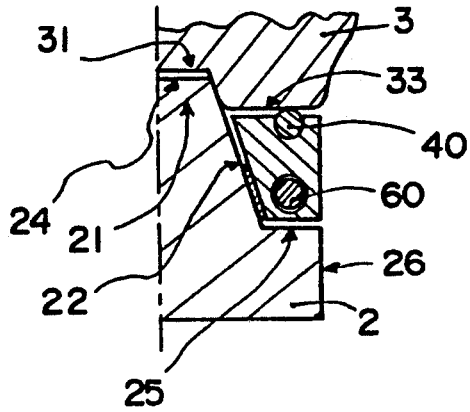
FIG. 3 is a transverse cross-sectional view of the detail of FIG. 2.

As shown in FIGS. 1 and 3, the biasing apparatus 4 is constituted by two beams 40, each positioned in a free space defined by the lower surface 25 and the lateral sides 22 of rib 21, on both sides thereof.

Beams 40 can likewise extend on each side of ski 2 particularly in the case of a ski 2 of rectangular cross-section or a ski not having a rib 21.

In the embodiment shown in FIGS. 1 and 3, the biasing apparatus 4, according to the invention, has the advantage of not presenting projecting portions with respect to the upper surface 24 of the rib and does not present a portion which extends beyond the exterior lateral sides 26 of the ski. Frictional forces of the snow on the beams is thus avoided. Furthermore, the bias apparatus in absolutely no way, detracts from the aesthetic appearance of the assembly constituted by the ski and its diverse accessories.

Another advantage presented by the bias apparatus 4, according to the invention, is to avoid a concentration of mass at the front of shoe 1, as is the case in the traditional biasing apparatus. In effect, beams 40 are positioned under shoe 1 while the spring of known types of bindings is positioned in front of shoe 1.

Return apparatus 4 having two beams 40 positioned in a symmetrical manner on both sides of rib 21 preferably brings back the shoe 1 to be flat on ski 2. The intensity of the return to be transmitted to the shoe 1 is distributed on the two beams 40, which makes it possible to reduce the necessary volume of each beam 40.

One can likewise have a return apparatus 4 which is non-symmetrical and which is adapted to particular ski techniques, according to a constructional design which is not shown.

The intermediate support apparatus 42 prevents only the translation of the beam 40 in the direction of bias o beam 40, i.e., in the vertical descending direction shown in FIG. 1. This intermediate support apparatus 42 is constituted by a support bar 5, introduced into one of the holes 48 of a series of traversing holes 48 provided in the rib 21 in a manner which is substantially transverse to the longitudinal axis of ski 2. The support bar 5 extends through rib 21 in a manner so as to simultaneously constitute the intermediate support apparatus 42 of each of beams 40 positioned on both sides of rib 21.

The position of the intermediate support apparatus 42 is likewise adjustable along the length of the longitudinal axis of ski 2. Depending upon the hole 48 of the series of holes 48 in which one introduces the support bar 5, the intensity of the bias is modified because the length of beam 40 is modified between the support bar 5 and the front end of beam 40, i.e., when one reduces the distance between the support bar 5 and the front end of beam 40, one reduces the amplitude of the movement of the front end of beam 40, and one thus increases the intensity of the bias. This solution thus proposes a discrete adjustment without disassembly of the return apparatus 4, thus being simple and rapid.

According to the embodiment of FIG. 1, the beams 40 extend preferably as far as under the heel 11 of shoe 1 in a manner such that the rear linkage apparatus 41 constitutes a heel support surface 11 of the sole 3. This heel support surface 11 of the sole can likewise be constituted by the beams 40 themselves.

In the case of FIG. 1, the beam 40 preferably serves as a support surface for the metatarsal zone 12 of sole 3. The metatarsal zone 12 can likewise rest directly on the intermediate support surface 42.

Furthermore, FIG. 1 illustrates a rear linkage apparatus 41 which makes it possible to dissociate the beams 40 from the ski 2. One can thus retract beams 40 which are thus removable, and replace them when they are broken or worn out, and likewise, if one desires, the intensity of the bias can be modified by changing the material of beams 40, for example.

Figure 2:
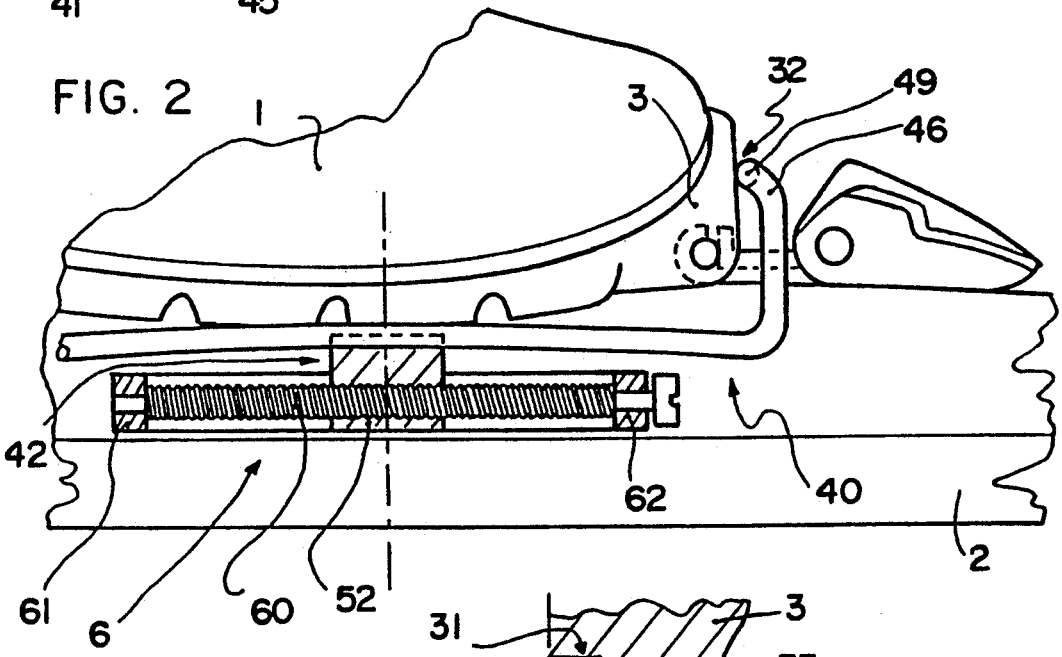
FIG. 2 is a longitudinal cross-sectional view of a detail of a second embodiment of the invention.

Each of beams 40 is extended in a substantially vertical fashion through an arm 46, likewise shown in FIG. 2. This arm 46 preferably comes into contact with a bias zone 32 constituted by a substantially transverse surface of the front of sole 3 in a manner so as to transmit the movement of sole 3 to beams 40 so as to bias them in flexion and/or torsion.

When the heel 11 is lifted, shoe 1 pivots around rotational axis 10. The bias zone 32 likewise pivots and then pushes the end of each of arms 46.

Each arm 46 thus pushes, in turn, the front end of each associated beam 40 vertically and downwardly. Beam 40 thus is supported on the associated support bar 5 and is retained by rear linkage apparatus 41. Each beam 40 is thus biased in flexion and charged with energy. This energy stored in beam 40 during the lifting of heel 11, is retransmitted to the shoe 1 through beams 40 during the descent of heel 11. The arms 46 then push the bias zone 32 in a manner so as to pivot shoe 1 in the descending direction of heel 11.

Beams 40 of such a return apparatus 4 are made of a material having a modulus of elevated elasticity, in a manner so as to assure a much more substantial return force than that caused by the known return apparatus.

The modulus of elasticity of the materials constituting the beams 40 is greater than 30.103 and can go up to $200.10^3$ MPa. Any type of material having this characteristic can thus be utilized.

The advantage of an elevated modulus of elasticity is that it furnishes a relatively elevated bias intensity by virtue of the substantial volume of the beams due to their length, this for a low displacement of the biased point, thus producing reduced amount of work, and thus reduced aging of the beams 40.

Furthermore, the ski 2 is better pressed on the snow during the phase of lifting of the heel 11 than with traditional spring bias apparatus because the shoe 1 biases the beams 40 which then press the ski 2 on the snow. The pressure field exerted by ski 2 on the snow is likewise displaced towards the rear in the direction of heel 11, which makes possible a better efficiency during the impulsion phase following the lifting of heel 11 by virtue of a better adherence of the ski 2 on the snow. The pressure field can, according to be a preferred embodiment, be centered to substantially under the metatarsal zone 12, particularly when the intermediate support apparatus 42 is positioned under the metatarsal zone 12.

Continuous adjustment means 6 for adjusting the position of the intermediate support apparatus 42 are shown by FIGS. 2 and 3. The rotation of an endless screw 60 guided in rotation and blocked in translation in the two bearings 61 and 62 are affixed to ski 2, causes the displacement of a support template 52 along the length of the longitudinal axis of ski 2.

One can likewise provide such means for adjusting the position of the rear linkage apparatus 41, according to a design not shown.

FIG. 4 illustrates a parallelpipedic cross-section of beams 40. This cross-section is utilized in the case of a flexional bias of beam 40. The cross-section of beams 40 can be rectangular, two of the sides of beam 40 being parallel and perpendicular to the flexional plane of beam 40. The flexional plane of beam 40 is defined as being the plane in which the neutral line of the beam 40 is displaced during the bias period. The advantage of a rectangular cross-section is that it presents for the same height and same width as the cross-section of beam 40, a moment of inertia of beam 40 which is more substantial than in the case of a circular cross-section.

Furthermore, FIGS. 1, 2, 3 and 6 illustrate beams 40 whose flexional planes are vertical.

These planes can assume any orientation in space and particularly also be inclined, as shown in FIG. 4.

The advantage that a vertical flexional plane has is that each of the beams 40 remains under the sole 3 during the lifting of heel 11. The beams 40 are thus not subjected to snow friction.

FIG. 4 likewise illustrates beams 40 comprising ramps 8 which cooperate with complementary ramps 23 provided on rib 21. The pressure of sole 3 on beams 40 and the vertical direction during lifting of the heel 11 causes a displacement of the beams 40 in the direction indicated by arrow F, and creates a bias of the flexion in each beam 40, along and inclined plane parallel to the lateral sides of each associated beam 40.

The lower surface 33 of sole 3 rests on the beams 40 in a manner so as to force each of them to slide along the length of the complementary ramps 23. One can likewise provide a lower surface 33 of sole 3 which is inclined in a manner so as to serve likewise as ramps along the length of which the beams 40 will slide in a manner so as to be biased in flexion by sole 3.

FIG. 5 illustrates beams 40 of circular transverse cross-section which are preferably utilized in the case of a torsional bias or of a torsional and flexional bias. This beam 40 can likewise be shown hollowed-out, i.e., having the form of a cylindrical tube, in a manner so as to reduce the weight of each beam 40.

Each beam 40 is supported on ramps 90 constituting a support apparatus 42 and provided on a staple 9 applied to rib 21, which may as desired be affixed in a removable manner so as to allow for replacement thereof in a manner so as to adjust the bias force of shoe 1 as a function of the type of skiing and of the skier. The staple 9 can likewise be an integral portion of ski 2. This construction makes it possible to bias the beams 40 simultaneously in torsion and in flexion, which increases the stored energy which is then retransmitted during biasing, by adding the transmitted energy from the flexional bias and the transmitted energy as a result of the torsional bias.

Figure 10:
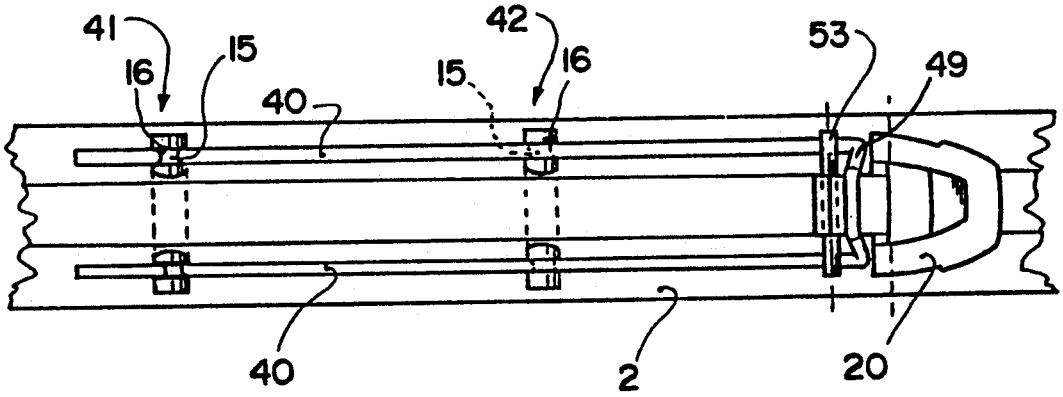
FIG. 10 is a top view of the fifth embodiment.

As shown in FIGS. 5 and 10, the two arms are connected, at a junction 49 which is substantially horizontal in a manner so as to preferably assure the symmetry of the return apparatus 4, and the distribution of the bias of each beam 40.

During pivoting of shoe 1, the bias zone 32 pushes junction 49.

This junction 49 pushes in turn the arms 46 which have a tendency to move away from one another when the beams 40 slide over the length of ramps 90. The junction 49 is preferably adapted to be deformed so as to allow for the spacing of arms 46.

The arms 46 and their junction 49 can assume any shape making it possible to transmit to the beams the bias (inverted V or U, arc of a circle, etc.) or be constituted by an applied element affixed to the beams 40 and which is rigid.

One can likewise provide two beams 40 of different length or cross-section, on each side of rib 21, or likewise linkage or support apparatus 41 or 42, respectively, which are different in a manner so as to have a bias apparatus 4 which is not symmetrical with respect to the median plane of ski 2, which can be advantageous depending upon the ski technique being practiced.

FIG. 6 illustrates a rear linkage apparatus 41 which only prevents the translation of beam 40 in the direction opposite to the bias, in the case of the flexion of beam 40. The intermediate support apparatus 42 only prevents the translation of beam 40 in the direction of the bias.

The assembly of these two apparatus 41 or 42 suffices effectively to maintain the beam 40 during the bias in flexion.

One must, however, provide maintenance means for maintaining beam 40 on ski 2 when shoe 1 does not bias beam 40. Shoulders 16 (FIG. 10) provided on the support bars 15, constituting the rear linkage apparatus 41 and intermediate support 42, can, for example, prevent the transverse escape of beams 40. This escape can likewise be avoided by any other apparatus preventing the translational movement of beam 40 in a substantially horizontal plane.

On the other hand, the apparatus described above do not suffice to maintain the beam 40 on the ski 2. One thus provides a supplemental latching of the beam 40 on the ski 2. This latch can, for example, be constituted by a latching pin which 53 traverses the ski 2 above each beam 40 and exerts a slight flexional bias of the beam 40 in a manner so as to prestress it when the shoe 1 is not on the ski 2, in a manner so as not to lose the beam 40.

When the shoe 1 is maintained on ski 2 by latching apparatus 20, latching pin 53 is not in contact with beam 40 in a manner so as to allow for the bias of the shoe 2 (FIG. 6).

The embodiments shown provide a latching apparatus 20 of boot 1 on ski 2 which is independent from the biasing apparatus 4 and in particular the beams 40. This latching apparatus 20 can thus be of any known type.

Figure 7:
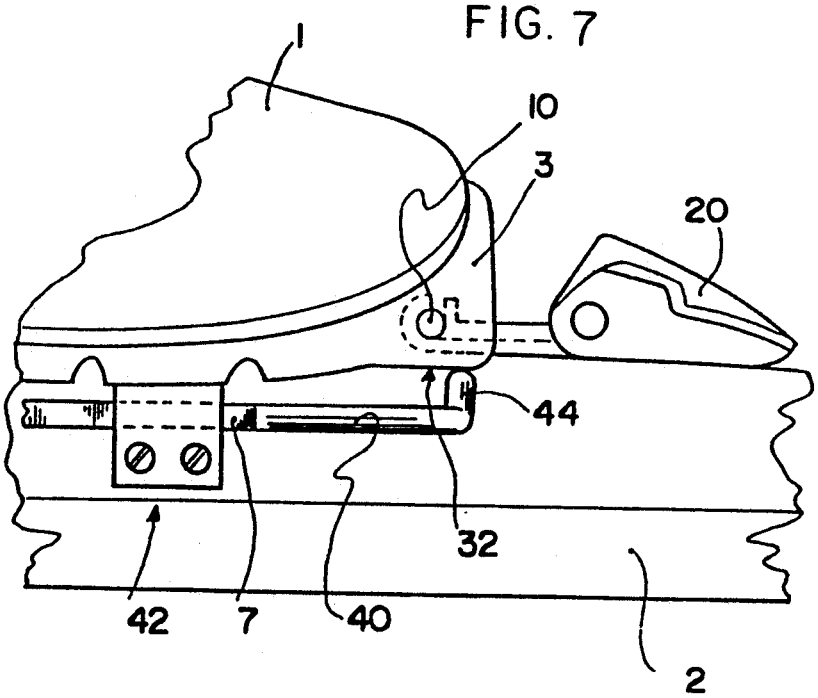
FIG. 7 is a side view of a sixth embodiment.
Figure 9:
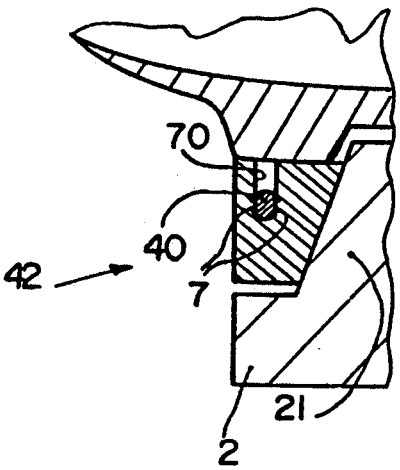
FIG. 9 is a transverse cross-sectional view of FIG. 7.
Figure 8:
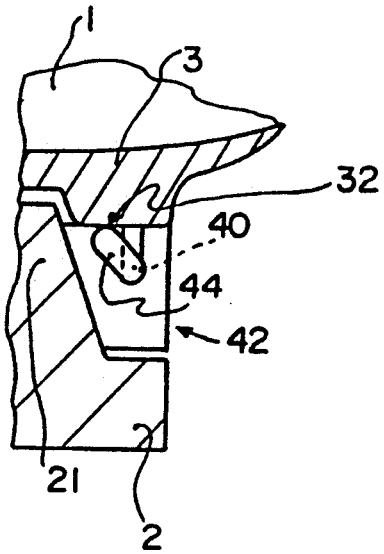
FIG. 8 is a transverse cross-sectional view of the sixth embodiment.

FIG. 7, 8 and 9 illustrate the case of a torsional bias. Cams 44 are provided which are affixed to each of the beams 40 in a manner so as to transform the movement of the sole 3 during the lifting of the heel 11, into torsional bias.

Each cam 44 is affixed to the front end of associated beam 40. The rotation of each beam 40 is prevented, either at its rear end by the rear linkage apparatus 41, not shown, or by the intermediate support apparatus 42, as shown in FIGS. 7 and 9. Beam 40 has two flat areas 7 which cooperate with a groove 70 provided in the intermediate support apparatus 42 affixed to the rib 21 of ski 2, in a manner so as to prevent the rotation of at least one point of beam 40.

The intermediate support apparatus 42 can likewise be adjustable along the length of the longitudinal axis of ski 2, in a manner so as to adjust the intensity of the bias in a manner identical to FIG. 1 or 2.

The bias zone 32 of beams 40 by shoe 1 is positioned in the case of torsion on the lower surface of sole 3, which is likewise possible during a flexional bias (not shown).

In this case, one can likewise provide that the latching apparatus 20 of shoe 1 on ski 2 causes a rotation of shoe 1 with respect to ski 2 along an axis 10 which is substantially transverse and situated at the rear in the direction of heel 11 with respect to bias zone 32. This makes it possible desirably to make a sufficient bias force of the foot by acting on the length of the lever arm defined by the distance between the bias zone 32 and the rotational axis 10.

The bias is increased the more that the lever arm is lifted. The situation will be, therefore, more advantageous if the axis 10 is situated far to the rear of the bias zone 32, while remaining, however, between this bias zone 32 and the intermediate support apparatus 42.

The instant application is based upon French patent application 90.02824, filed Mar. 2, 1990, the priority of which is hereby claimed, and the disclosure and drawings of which are hereby incorporated specifically by reference thereto.

Finally, although the invention has been described with reference of particular means, materials and embodiments, it is to be understood that the invention is not limited to the particulars disclosed and extends to all equivlents within the scope of the claims.

What is claimed is:

1. A biasing apparatus for biasing a shoe on a ski, the ski shoe comprising an external sole maintained on the ski at its front end by a latching apparatus, said latching apparatus permitting lifting of the rear part of the shoe from the ski, said lifting occurring against biasing action of said biasing apparatus, said biasing action acting to bias the rear part of the shoe against the ski, wherein the biasing apparatus of the shoe on the ski is constituted by at least one beam defined by one front and one rear end, said at least one beam being linked with the ski at its rear end through a rear linkage apparatus, its front end being free and directly contacting and biased by the shoe in a bias zone, during lifting of the shoe, said at least one beam being likewise linked with the ski between its rear end and its front end by at least one intermediate support means for preventing downward movement of said at least one beam.

2. The biasing apparatus as defined by claim 1 wherein the material constituting said at least one beam has a modulus of elasticity greater than $30\times10^3$ MPa.

3. The biasing apparatus as defined by claim 1 wherein said at least one beam extends longitudinally under the sole of the shoe.

4. The biasing apparatus as defined by claim 3 wherein the sole of the shoe comprises a groove which is substantially longitudinal and defined by a lower surface of the sole and cooperating with a corresponding substantially longitudinal rib provided on the ski and defined by two lateral sides, wherein the biasing apparatus comprises two beams, each one of said two beams being lodged in one of the free spaces positioned on both sides of the rib provided on the ski and defined by the lower surface and the lateral sides of the rib facing one another.

5. The biasing apparatus as defined by claim 4 wherein said two beams are of the same transverse cross-section.

6. The biasing apparatus as defined by claim 4 wherein said two beams are of the same length.

7. The biasing apparatus as defined by claim 4 wherein said two beams are of the same material.

8. The biasing apparatus as defined by claim 4 wherein each of the two rear linkage apparatus of each of the two beams are identical.

9. The biasing apparatus as defined by claim 4 comprising two intermediate support means, wherein the two intermediate support means are identical.

10. The biasing apparatus as defined by claim 1 wherein the latching apparatus of the front end of the sole on the ski is independent of said at least one beam constituting the biasing apparatus.

11. The biasing apparatus as defined by claim 1 wherein said at least one intermediate support means of said at least one beam constitutes a support surface of a metatarsal zone of the sole on the ski.

12. The biasing apparatus as defined by claim 1 wherein said at least one beam constitutes a support surface of a metatarsal zone of the sole on the ski.

13. The biasing apparatus as defined by claim 1 wherein a pressure field of the ski on the snow is positioned under the shoe.

14. The biasing apparatus as defined by claim 1 wherein a pressure field of the ski on the snow is centered in a metatarsal zone.

15. The biasing apparatus as defined by claim 1 wherein said at least one intermediate support means of said at least one beam prevents at least a translational movement of the corresponding beam in the direction of the bias by the shoe.

16. The biasing apparatus as defined by claim 1 wherein said at least one intermediate support means of said at least one beam prevents at least the rotation of the corresponding beam in the direction of the bias by the shoe.

17. The biasing apparatus as defined by claim 1 wherein at least one rear linkage apparatus of said at least one beam suppresses at least the degrees of freedom of said at least one beam in the direction of the bias of said at least one beam by the shoe.

18. The biasing apparatus as defined by claim 15 wherein said rear linkage apparatus of said at least one beam is cantilevered to suppress any degree of freedom of the associated beam with respect to the ski.

19. The biasing apparatus as defined by claim 15 wherein the rear linkage apparatus of said at least one beam with the ski prevents at least the translational movement of said at least one beam in the direction opposite to the bias by the shoe.

20. The biasing apparatus as defined by claim 1 wherein said at least one beam extends longitudinally as far as under the heel of the sole.

21. The biasing apparatus as defined by claim 20 wherein the rear linkage apparatus of said at least one beam which extends longitudinally as far as under the heel constitutes a support surface of the heel of the sole on the ski.

22. The biasing apparatus as defined by claim 20 wherein said at least one beam constitutes a support surface of the heel of the sole of the ski.

23. The biasing apparatus as defined by claim 1 wherein an assembly constituted by said rear linkage apparatus and said at least one intermediate support means of said at least one beam makes it possible to remove said biasing apparatus from the ski.

24. The biasing apparatus as defined by claim 1 wherein the rear linkage apparatus of said at least one beam comprises adjustment means for adjusting the position thereof along the length of the longitudinal axis of the ski.

25. The biasing apparatus as defined by claim 24 wherein the adjustment means allows for a discrete adjustment.

26. The biasing apparatus as defined by claim 24 wherein the adjustment means allow for continuous adjustment.

27. The biasing apparatus as defined by claim 24 wherein at least two intermediate support means are each associated with a respective beam situated on both sides of the rib, comprise a common adjustment means making possible simultaneous adjustment of the two support means.

28. The biasing apparatus as defined by claim 1 wherein the bias exerted by the shoe on said at least one beam is composed of flexional bias in at least one plane.

29. The biasing apparatus as defined by claim 28 wherein said at least one beam is solid.

30. The biasing apparatus as defined by claim 28 wherein said at least one beam is hollow.

31. The biasing apparatus as defined by claim 28 wherein a traverse cross-section of said at least one beam biased in torsion is circular.

32. The biasing apparatus as defined by claim 28 wherein said at least one beam biased in torsion is biased by a cam affixed to the beam.

33. The biasing apparatus as defined by claim 28 wherein the transverse cross-section of said at least one beam biased in flexion is a parallelepiped.

34. The biasing apparatus as defined by claim 28 wherein said at least one plane is substantially vertical.

35. The biasing apparatus as defined by claim 28 wherein said at least one plane is substantially horizontal.

36. The biasing apparatus as defined by claim 28 wherein said at least one beam biased in flexion has a rectangular transverse cross-section.

37. The biasing apparatus as defined by claim 1 wherein said linkage apparatus of said at least one beam is constituted by at least one apparatus applied to the ski and affixed thereon.

38. The biasing apparatus as defined by claim 37 wherein said at least one of the applied apparatus is constituted by a staple covering a rib provided on the ski.

39. The biasing apparatus as defined by claim 28 wherein said at least one beam includes a ramp cooperating with a complementary ramp provided on said linkage apparatus or support apparatus.

40. The biasing apparatus as defined by claim 28 wherein a bias zone of the shoe is positioned on the lower surface of the sole.

41. The biasing apparatus as defined by claim 28 wherein a bias zone of the shoe is at least in part positioned on the front end of the sole, substantially transverse to the longitudinal axis of the shoe.

42. The biasing apparatus as defined by claim 41 wherein said at least one beam biased by the front transverse end of the sole is affixed to an arm extending from the beam in a manner which is substantially transverse said arm of said free front end of said beam comes into contact with the bias zone of the shoe.

43. The biasing apparatus as defined by claim 41 wherein two beam are each affixed to an arm said two arms being connected to one another and comprising said free front end of said two beams.

44. The biasing apparatus as defined by claim 40 wherein the latching apparatus of the sole on the ski allows for the rotation of the shoe around a rotational axis which is substantially transverse to the ski, and wherein the rotational axis is positioned between the bias zone and an intermediate support zone.

45. The biasing apparatus as defined by claim 1 wherein the rear linkage apparatus of said at least one intermediate support means of said at least one beam comprises adjustment means for adjusting the position thereof along the length of the longitudinal axis of the ski.

46. The biasing apparatus as defined by claim 1 wherein the bias exerted by the shoe on said at least one beam is composed of at least one torsional bias.

47. The biasing apparatus as defined by claim 1 wherein said support apparatus of said at least one beam is constituted by at least one means applied to the ski and affixed thereon.

48. The biasing apparatus as defined by claim 28 wherein said at least one beam includes a ramp cooperating with a complementary ramp provided on said support means.

49. The biasing apparatus as defined by claim 28 wherein said at least one beam includes a ramp cooperating with a complementary ramp provided on at least one portion of the lower surface of the sole.

* * * * *